United States Patent [19]

Uchikune et al.

[11] 4,401,960

[45] Aug. 30, 1983

[54] MAGNET ASSEMBLY

[75] Inventors: Mamoru Uchikune; Mutsukazu Tagami, both of Ueda; Taketo Shimizu, Nagano; Kiyoshi Yanagisawa, Ueda; Katsuto Yokosawa, Nagano; Kunio Horiuchi; Hiroo Sakaguchi, both of Ueda, all of Ueda, Japan

[73] Assignee: Kanetsu Kogyo Kabushiki Kaisha, Nagano, Japan

[21] Appl. No.: 104,720

[22] Filed: Dec. 18, 1979

[51] Int. Cl.[3] ..... H01F 7/20

[52] U.S. Cl. ..... 335/285; 335/304

[58] Field of Search ..... 294/65.5; 335/306, 285, 335/295, 302, 303, 304

[56] References Cited

U.S. PATENT DOCUMENTS 3,079,191 2/1963 Engelsted et al. ..... 294/65.5

3,223,898 12/1965 Bey ..... 335/295

3,428,867 2/1969 Becker ..... 335/285 X

*Primary Examiner*—George Harris

*Attorney, Agent, or Firm*—Stephen F. K. Yee

[57] ABSTRACT

A magnet assembly used as a magnetism generating source for attaching an article to a magnetic substance or for magnetically retaining a magnetic member. The magnet assembly consists of a cylindrical casing open at least at one end, a core disposed within the casing at a spacing from an inner wall thereof, with one end of the core aligned with the open end face of the casing, and a permanent magnet disposed between the core and the inner peripheral surface of the casing. The permanent magnet has one magnetic pole on an outer surface thereof opposing the inner peripheral surface of the casing, and the other magnetic pole opposite the magnetic pole on an inner surface thereof opposing the outer peripheral surface of the core, so that the open end face of the casing and the end face of the core serve as a magnetic attraction surface.

7 Claims, 5 Drawing Figures

MAGNET ASSEMBLY

BACKGROUND OF THE INVENTION

1. Field of the Invention

This invention relates to a magnet assembly adapted for incorporation as a magnetism generating source in an article, so as to attach such an article to a magnetic substance, or adapted for incorporation as a magnetism generating source in a magnetic lifting device or the like for magnetically retaining a magnetic member or magnetic substance such as steel.

2. Description of the Prior Art

A prior-art magnet assembly as shown in FIG. 1 includes a columnar permanent magnet 10 and a cylindrical casing 12 made of a magnetic material which houses therein the permanent magnet and is open at one end. The permanent magnet 10 is disposed within the casing 12 at a spacing from an inner peripheral surface of the casing coaxially therewith. The permanent magnet 10 is magnetized in the longitudinal direction thereof in a manner to form a pair of magnetic poles at the opposite ends 10*a* and 10*b* thereof. One magnetic pole at one end of the permanent magnet 10 contacts the closed end of the casing 12, and a magnetic pole piece 14 contacts the other end of the permanent magnet 10. The magnetic pole piece 14 is attached, through the medium of a ring 16 made of a non-magnetic material, to the inner circumferential edge at the open end of the casing 12.

In the aforesaid magnet assembly, the open end face of the casing 12 and one surface of the magnetic pole piece 14 aligning with the open end face form a magnetic attraction surface 18, on which the magnetic force of the permanent magnet 10 effectively acts as a magnetically attracting force.

The aforesaid magnetically attracting force is proportional to the product of the square of a residual magnetic flux density of the permanent magnet and a cross sectional area perpendicular to a direction of magnetization, namely, a magnetic pole surface. In the structure shown in FIG. 1 in which the permanent magnet is of a columnar shape having magnetic pole surfaces at the opposite ends thereof, when it is desired to increase a magnetic pole surface area, a large permanent magnet is required, thus resulting in a large size magnet assembly. To cope with this, an alnico magnet has been used as a permanent magnet for the magnet assembly which magnet is high in residual magnetic flux density and generates a strong magnetic force from a comparatively small magnetic pole surface.

However, a material for the alnico magnet is an alloy containing a large amount of cobalt or nickel, either of which is expensive, and unstable in demand and supply, suffering from the influence of the international situations. The material is accordingly expensive and hardly obtainable.

An easily obtainable magnet is, for example, a ferrite magnet having a high coercive force. Despite a high coercive force, such a magnet is low in residual magnetic flux density. The residual magnetic flux density of the aforesaid alnico magnet is in the range of 10,000 to 12,000 gauss, and that of the ferrite magnet is in the range of 3,000 to 4,000 gauss. Assuming that the magnetic flux of a magnet wholly acts as a magnetically attracting force, the magnetically attracting force is 4.00 to 5.76 kg/cm$^2$ in the former and 0.36 to 0.64 kg/cm$^2$ in the latter. From this, it will be apparent that when it is desired to use a ferrite magnet for the aforesaid prior art magnet assembly, a large permanent magnet is required, which has a magnetic pole surface increased to three or four time that of a conventional alnico magnet, in order to provide for the magnetic attraction surface a magnetically attracting force increased to a level equal to that of the conventional one, thus resulting in an increased sized magnet assembly.

SUMMARY OF THE INVENTION.

It is accordingly an object of the present invention to provide a magnet assembly, wherein a desired magnetically attracting force is obtained even by a permanent magnet having a low magnetic flux density and a high coercive force, typically a ferrite magnet, and which is compact in size.

To attain the object, there if provided according to the present invention a magnet assembly including a permanent magnet and a cylindrical casing made of a magnetic material, open at least at one end and housing therein the permanent magnet, the aforesaid casing housing therein a core, the core being disposed in the casing at an spacing from the inner wall thereof, the permanent magnet being disposed between the casing and the core and having one magnetic pole in an outer face opposing the inner peripheral surface of the casing and the other magnetic pole, which is opposite the aforesaid one magnetic pole, in an inner face opposing the outer peripheral wall of the core, and the circumferential face at the open end of the casing and one end face of the core, which is positioned on the open end side of the casing, serving as magnetic attraction surfaces.

DESCRIPTION OF THE PREFERRED EMBODIMENTS

Figure 2:
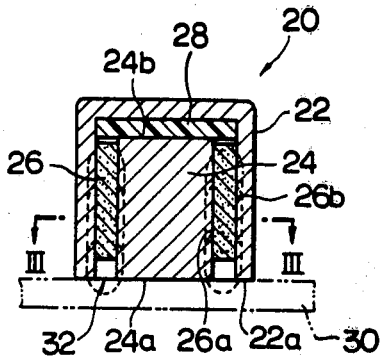
FIG. 2 is a longitudinal cross sectional view of a magnet assembly relating to the present invention.

In FIG. 2, a magnet assembly according to the present invention is generally shown by reference numeral 20. The magnet assembly 20 comprises a cylindrical casing 22 made of a magnetic material and open at one end, a core 24 housed in the casing 22, and a permanent magnet 26.

The core 24 is made of a columnar magnetic member and disposed within the casing 22, with one end face 24*a* of the former aligned with an open end face 22*a* of the latter at a spacing from the inner wall of the casing coaxially therewith. A spacer 28 made of a non-magnetic substance is placed between the other end face 24*b* of the core 24 and the closed end of the casing 22, the spacer serving to properly position the core 24 relative to the casing and being rigidly secured to the casing 22 and the core 24.

Figure 3:
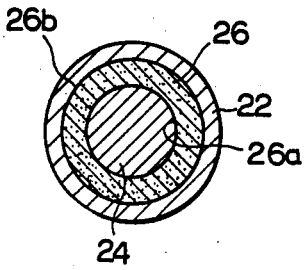
FIG. 3 is a transverse cross sectional view taken along the line III—III of FIG. 2.

The permanent magnet 26 is of a cylindrical shape, which surrounds the core 24 completely, as best seen in FIG. 3, with an inner peripheral wall 26*a* thereof contacting the outer peripheral wall of the core 24 and an outer peripheral wall 26*b* contacting the inner peripheral surface of the casing 22. The permanent magnet 26 has one magnetic pole ( N or S pole ) on the inner peripheral surface 26*a* thereof and the other magnetic pole ( S or N pole ) on the outer peripheral surface 26*b* thereof, so that the both peripheral surfaces 26*a* and 26*b* thereof make a pair of magnetic pole surfaces.

In the magnet assembly 20 according to the present invention, magnetic circuits as shown in FIG. 2 are formed by the permanent magnet 26, so that the open end face 22*a* of the casing 22 and the one end face 24*a* of the core 24 form a magnetic attraction surface for magnetically attracting an object 30, such as an iron piece.

Figure 1:
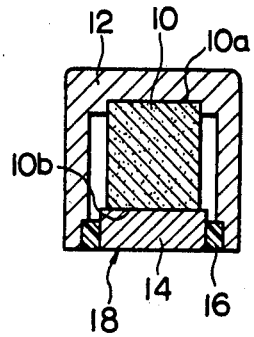
FIG. 1 PRIOR ART
FIG. 1 is a longitudinal cross sectional view of a prior art magnet assembly.

The aforesaid magnet assembly has a cylindrical permanent magnet 26, the inner peripheral surface 26*a* and the outer peripheral surface 26*b* of which cooperate to form a pair of magnetic pole surfaces. From this, it will be understood that the magnetic pole area of the permanent magnet 26 is increased to more than four times the magnetic pole area of the cylindrical permanent magnet 10 used in the aforesaid prior art magnet assembly as shown in FIG. 1, without increasing the size of the magnet assembly itself.

Even in a ferrite magnet having a low residual magnetic flux density on the order of 4,000 gauss, a magnetic flux density in the magnetic attraction surface thereof is increased to above 16,000 ( $=4{,}000\times4$ ) gauss by causing the magnetic flux of the permanent magnet 26 to effectively act on the aforesaid attraction surface, whereby the magnet assembly 20, in which the ferrite magnet having a high coercive force and a low magnetic flux density is employed, presents a magnetically attracting force increased to a level substantially equal to that of the aforesaid prior art magnet assembly. A magnet assembly (the casing having an outer diameter of 32 mm), made on an experimental basis by the inventors by using a ferrite magnet as the permanent magnet 26, exhibited 65 kg of magnetically attracting force.

The magnet assembly shown in FIG. 2 has the spacer 28, made of a non-magnetic material, between the closed end face of the casing 22 and the end face 24*b* of the core. Such a spacer may be omitted. In the latter case, the core 24 should be rigidly secured, through the medium of the magnet 26, to the casing 22, to the effect that a gap between the close end face and the end face 24*b* of the core is maintained.

Figure 2A:
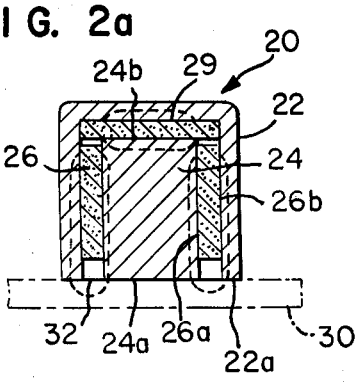
FIG. 2*a* is a view similar to FIG. 2, showing a modification of the magnet assembly.

Instead of the spacer 28, another permanent magnet 29 may be disposed between the closed end face of the casing 22 and the end face 24*b* of the core 24, as shown in FIG. 2*a*, permament magnet has a magnetic pole the same in polarity as the magnetic pole on the outer peripheral surface 26*b* of the permanent magnet 26 in the outer surface contacting in an opposed relation to the close end of the casing, and a magnetic pole the same in polarity as that on the inner peripheral surface 24*b* of the permanent magnet 26 on the inner surface contacting in an opposed relation the other end face 24*b* of the core 24, so that the magnet imparts a diamagnetic field to the magnetic flux leaked from the end face 24*b* of the core 24, thereby increasing the magnetic flux to be induced to a magnetic attraction surface 32, thereby providing an increased magnetic attracting force for the aforesaid magnetic attraction surface.

Figure 4:
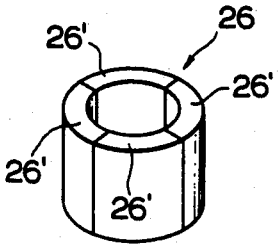
FIG. 4 is a perspective view of a permanent magnet which is a modification of those shown in FIGS. 2 and 3; and, FIG. 5 is a longitudinal cross sectional view of another embodiment.

The permanent magnet 26 may be a combination of plural arcuate segments of a magnet 26' as shown in FIG. 4. The permanent magnet 26 may be a flexible magnet, such as the so-called rubber magnet, or made of a magnetized plastic material. The aforessaid permanent magnet having a low magnetic flux density may be replaced by a permanent magnet having a high magnetic flux density, such as an alnico magnet, for providing a stronger magnetically attracting force for the magnet assembly produced. Where the permanent magnet 26 is an alnico magnet, such a permanent magnet may consist of one or more arcuate segments of magnet, as shown in FIG. 4.

Figure 5:
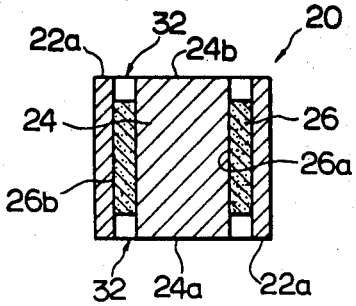

The magnet assembly so far described has the magnetic attraction surface at one end. As an alternative, the magnetic attraction surface 32 is formed at each end of the magnet assembly 20 by using a casing 22 which is open at the opposite ends and disposing the core 24 within the casing, with the opposite end faces 24*a* and 24*b* thereof aligned with the opposite open end faces of the casing, as shown in FIG. 5.

According to the present invention, a permanent magnet having a high coercive force and a low magnetic flux density, such as a ferrite magnet, is used for providing the magnet assembly with a magnetically attracting force increased to a level substantially equal to that of the prior art magnet assembly. Such a ferrite magnet has a high coercive force, without a likelihood of being demagnetized due to an impact, vibration and/or an external demagnetizing field, with the result of increased durability. Employment of a permanent magnet having a high magnetic flux density, such as an alnico magnet, provides a stronger magnetically attracting force for the magnet assembly produced, as compared with that of a prior art magnet assembly.

We claim:

1. A magnet assembly comprising:

a cylindrical casing made of a magnetic material, opened at one end and closed at the other end;

a core disposed within said casing and positioned to define a spacing between the inner surface of the casing and the exterior peripheral surface of the core, an end surface of the core being coplanar with the open end surface of the casing to form a magnetic attraction surface;

a permanent magnet disposed within said spacing between said core and said casing, said magnet having one magnetic pole on the exterior surface opposite the inner surface of said casing and the other magnetic pole on the inner surface opposite the exterior peripheral surface of said core;

a gap provided between the closed end of said casing and the adjacent end surfaces of said core and said permanent magnet; and a spacer disposed within said gap and contacting the opposed surfaces of said casing and said core to maintain the core stationary within the casing.

2. A magnet assembly as defined in claim 1, wherein said spacer is made of a non-magnetic substance.

3. A magnet assembly as defined in claim 1, wherein said spacer is another permanent magnet having one magnetic pole on the surface disposed opposite the closed end face of said casing, and the other magnetic pole on the surface disposed opposite the adjacent end surface of said core.

4. A magnet assembly comprising:

a cylindrical casing made of a magnetic material and open at both ends;

a core disposed within said casing and positioned to define a spacing between the inner surface of the casing and the exterior peripheral surface of the core, the end surfaces of said core being coplanar with the respective open end surfaces of said casing to form magnetic attraction surfaces; and a permanent magnet disposed within said spacing between said core and said casing, said magnet having one magnetic pole on the exterior surface opposite the inner surface of said casing and the other magnetic pole on the inner surface opposite the exterior peripheral surface of said core.

5. A magnet assembly as defined in claim 1, wherein said permanent magnet is a ferrite magnet.

6. A magnet assembly as defined in claim 1, wherein said permanent magnet is of a cylindrical shape.

7. A magnet assembly as defined in claim 1, wherein said permanent magnet consists of plural arcuate segments of magnet.

* * * * *